United States Patent [19]

May

[11] 4,395,797

[45] Aug. 2, 1983

[54] SELF ATTACHING HOLDER

[76] Inventor: Marvin I. May, 436 Ardmore Ave., Hermosa Beach, Calif. 90254

[21] Appl. No.: 198,524

[22] Filed: Oct. 20, 1980

[51] Int. Cl.[3] ..... A47C 21/02

[52] U.S. Cl. ..... 24/72.5; 5/451; 24/255 R

[58] Field of Search ..... 24/32, 34, 72.5, 255 R, 24/67.3, 67.9, 67.11; 211/45; 52/716, 717, 718, 242, 287, 288, 290; 160/399, 349; 5/451

[56] References Cited

U.S. PATENT DOCUMENTS

| | | | |
|---|---|---|---|
| 2,232,194 | 2/1941 | Zogby | 160/349 |
| 3,143,165 | 8/1964 | Lewis et al. | 160/179 |
| 3,973,282 | 8/1976 | May | 5/451 |
| 4,083,592 | 4/1978 | Rubin et al. | 52/716 |
| 4,107,826 | 8/1978 | Tysdal | 160/399 |
| 4,279,061 | 7/1981 | Santo | 24/255 R |

*Primary Examiner*—Robert A. Hafer
*Attorney, Agent, or Firm*—Romney, Golant, Martin, Disner & Ashen

[57] ABSTRACT

A holder for retaining sheet material such as a water bed liner against a surface such as a bed frame. The holder contains a head portion, a center portion and a leg portion. The head portion is biased to press against the surface to which the holder is attached. The center portion forms a space to hold a portion of the material. The leg portion includes a U-shaped portion insertable into a groove in the surface for removably securing the holder to the surface.

12 Claims, 6 Drawing Figures

SELF ATTACHING HOLDER

BACKGROUND OF THE INVENTION

1. Field of the Invention

The present invention relates to a holder and, more particularly, to a holder which may be used to secure the liner of a water bed or a plastic, cloth or paper decoration to a surface. The holder can be quickly and easily attached to and removed from any flat surface which contains an appropriate groove.

2. Description of the Prior Art

Holders of a similar type to that disclosed herein are described in my earlier U.S. Pat. Nos. 3,973,282 and 4,089,075. As pointed out these holders are easy to use and inexpensive to fabricate.

The prior holders comprise three main integral portions: an upper or head portion, a center portion, and a lower or leg portion.

The head portion is designed with a slightly beveled top to allow the insertion of the fingertips of an assembler. Inserting the fingers allows the moving or flexing of the head portion away from the surface and the insertion of the ends of a water bed liner or other sheet material into a storage space. This storage space is formed by the center portion which is slightly bowed to form the space between itself and the surface.

The leg portion is used to position and retain the holder in a preselected location generally by being fastened with bolts or screws to a surface. Other methods of attaching the holder include gluing, tacking, and force wedging with another member.

In order to be self-biasing or have spring-like action, the holder is designed to have the head portion offset by approximately one-eighth inch. When the holder is unattached with nothing to bias the head portion it will be about one-eighth inch offset from the leg portion. However, when the leg portion is aligned vertically with the surface, the surface biases the head portion. Thus, when the holder is connected to the surface the head portion will be forced back about one-eighth of an inch. This places an overstress in the center portion of the holder which induces a biasing force in the holder against the surface. This biasing force will insure an adequate restraint on the sheet material once it is tucked over the head portion and into the space and will also provide the spring-back feature. Hence, once tucking is completed, the assembler need only remove his fingers and the holder will spring back against the surface.

It has been found that a holder of rigid polyvinylchloride material having a thickness of approximately 0.050 inches provides sufficient resiliency and works exceedingly well.

Although this holder works extremely well and is effective in holding the water bed liner or other sheet material securely in place it may prove somewhat inconvenient to fasten to a surface. Not only do the screws and bolts require a lot of time to install, but they also constitute an additional cost in both material and assembly time. In addition, fastening the holder in this manner may limit the types of surfaces to which the holder can be attached. Furthermore, the number of fasteners and their spacing are factors affecting the tension exerted by the holder. An even tension is very difficult to achieve.

The other methods of attaching the holder are more permanent in nature. For example, the counter molding used in connection with forced wedging has a barbed section. The barbs bite both the holder and the surface. The holder is thereby firmly secured but removal damages the holder and the surface and reattachment is difficult if not impossible.

SUMMARY OF THE INVENTION

The above-mentioned problems are overcome by the present invention which provides an improvement to the holders of U.S. Pat. Nos. 3,973,282 and 4,089,075 wherein the holder comprises a head portion for bearing against a surface with material being receivable between the head portion and the surface, a center portion connected to the head portion and bowed to form with the surface a space for storage of a portion of the material, and a leg portion having a generally U-shaped part, said leg portion being connected to the center portion and said U-shaped part being insertable into a groove for detachably connecting the holder to the surface.

An object of the present invention is to provide a simple and easily manufactured holder which may be conveniently and quickly attached to and removed from a surface without damaging either the holder or the surface.

Another aspect of the present invention is to provide a holder that can be easily attached to or removed from a surface and yet not detach when flexed to receive material to be held.

Still another aim of the present invention is to provide a holder with a leg portion that can be securely and snugly inserted into a groove in a surface to securely fasten the holder to the surface; this may be done without any tools and yet an even, lateral pressure is created. Thus, the wall thickness of the holder may be minimized.

Yet another object of the present invention is to provide a holder which is reliable and yet inexpensive and one which does not require additional fasteners for securing purposes.

The foregoing objects, advantages, features and results of the present invention together with various objects, advantages, features and results thereof which will be evident to those skilled in the art in light of this disclosure may be achieved with the exemplary embodiment of the invention described in detail hereinafter and illustrated in the accompanying drawings.

DESCRIPTION OF THE PREFERRED EMBODIMENTS

Figure 1:
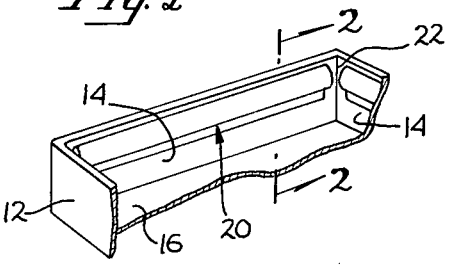
FIG. 1 is a perspective view of a portion of a water bed frame shown with the holder attached to the inner surface of the frame.

While the present invention is susceptible of various modifications and alternative constructions, illustrative embodiments are shown in the drawings and will be described in detail herein. It should be understood, however, that it is not the intention to limit the invention to the particular forms disclosed, but, on the contrary, the intention is to cover all modifications, equivalences, and alternative constructions falling within the spirit and scope of the invention as expressed in the appended claims.

Referring now to FIG. 1 there is illustrated a water bed frame 12 having interior lateral surfaces or perimeter 14 and a bottom member 16. A holder 20 comprises an elongated element shown attached to the interior surfaces 14, extending substantially the length of each side of the perimeter and coming within about an inch and one-half of each of the corners of the perimeter such as at a corner 22.

As mentioned, holders designed for retaining water bed liners or other sheet material were disclosed in my earlier U.S. Pat. Nos. 3,973,282 and 4,089,075. The holder disclosed herein, however, has a number of advantages over my previous holders. One improvement allows the holder to be easily and detachably connected to a surface such as a bed frame, and yet be easily flexed so that material can be tucked. Another improvement allows the holder to be used with a rail cap as will be described hereinbelow.

Figure 2:
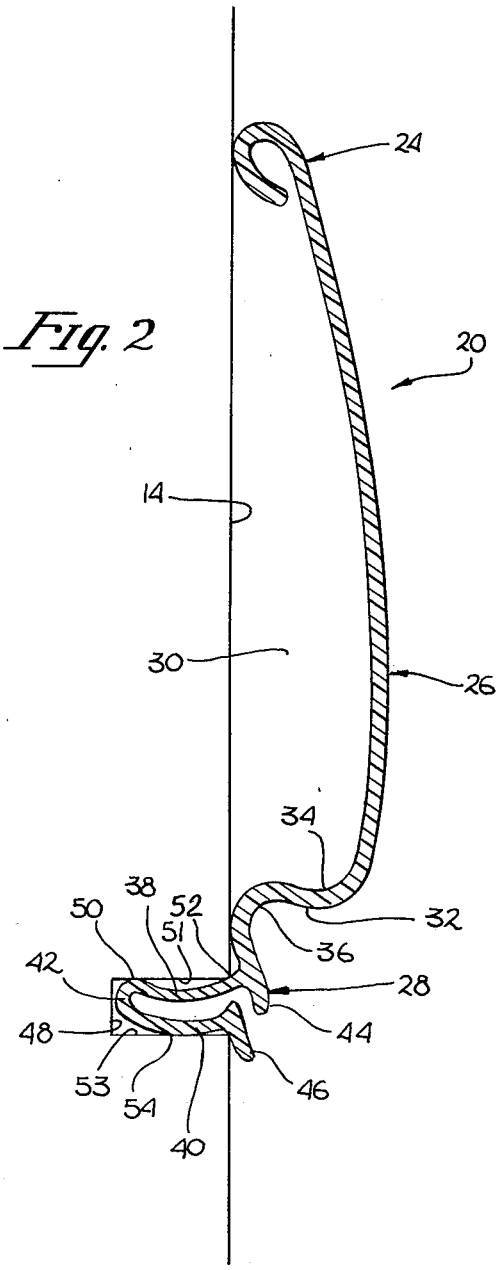
FIG. 2 is an enlarged elevational sectional view taken along line 202 of FIG. 1 illustrating the holder in use.
Figure 3:
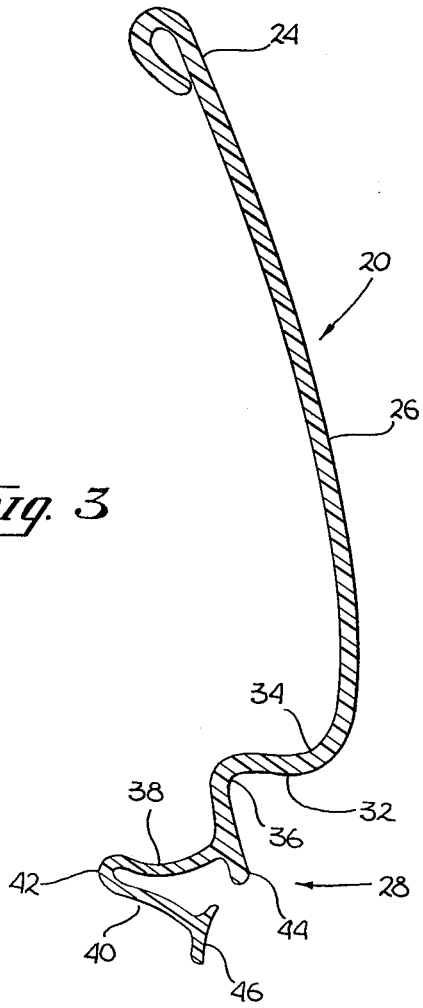
FIG. 3 is an elevational sectional view of an unflexed holder before attachment.

Referring to FIG. 2, the holder 20 includes an upper or head portion 24, a center portion 26, and a leg portion 28. It has been found suitable that the holder have a height of about three inches. In order to provide the self-biasing or spring-like action of the holder, it is designed to have the head portion 24 offset by approximately one-eighth of an inch to the left as shown in FIG. 3. However, when the holder is attached to a flat surface, the surface biases the head portion. Thus, when the holder is connected to the frame, the head portion will be forced back about one-eighth of an inch as shown in FIG. 2. This places an overstress in the center portion of the holder which induces a biasing force in the holder against the interior lateral surface 14.

The center portion is slightly bowed to form between itself and the surface 14 a storage space designated 30. The storage space provides a place for the material tucked into the holder. The biasing force insures an adequate restraint on the sheet material and also provides a spring-back feature for the holder. Hence, once tucking is completed, the assembler need only remove his fingers and the holder will spring back against the material.

The leg portion 28 is integral with the center portion of the holder and comprises a reverse S-shaped part having a spine 32 and oppositely directed curved fingers 34 and 36. The leg portion also includes a U-shaped part having an upper arm 38 and a lower arm 40. The extended ends of the arms 38 and 40 are connected together via a base 42. A push bar 44 is connected to the other end of the upper arm and a spacer 46 is connected to the other end of the lower arm.

One way in which the present invention differs from the previous patented holders is by the simple and reliable means provided for quickly and easily attaching and removing the holder from a surface.

This particular improvement relates to the leg portion of the holder; the upper and center portion of the new holder may be identical to those portions of the previously patented holders.

Still referring to FIG. 2, it can be seen that the leg portion 28 of the holder 20 comprises a unique attaching means. As mentioned, the attaching means is generally U-shaped including the arcuate upper arm 38 and the arcuate lower arm 40 extending from and flexibly attached to the base 42 so that the lower arm 40 is movable relative to the upper arm 38.

It should be noted that the securing holder is made of a single piece of material extruded in a special shape. The shape is designed so that the holder will exert tensions in particular directions when positioned in place. This one-piece construction allows for easy and inexpensive fabrication of holders of consistently high quality.

FIG. 2 illustrates the manner in which the holder 20 is attached to a surface such as the lateral surface 14 of the water bed frame 12. The surface must be provided with a groove 48. The leg portion of the holder, comprising the arms 38 and 40 extending from the base 42, is inserted into the groove 48. As is readily apparent from FIG. 3, when unstressed the other ends of the arms 38 and 40 are separated by a distance greater than the width of the groove 48. Thus, the arms 38 and 40 are compressed as they are inserted into the groove. The base 42 flexes in order to facilitate this compression. This resiliency creates a spring-like force directing the arms 38 and 40 towards their unstressed position, thereby tightly pressing against the groove. Thus, the leg portion of the holder acts as a clasp when inserted into the groove.

The unique shape of the arms 38 and 40 further facilitates a secure attachment to the groove 48. FIG. 2 illustrates the holder in its attached position. Note that locations designated as 50 and 52 of the upper arm 38 contact the top surface 51 of the groove while the location designated as 54 of the lower arm 40 contacts the bottom surface 53 of the groove. This three point clasp securely maintains the holder in place.

The leg portion of the holder 20 is shown in detail in FIG. 3. The push bar 44 is formed at the end of the upper arm 38. The push bar facilitates the insertion of the arms into the groove by providing a convenient surface with which to push the arms into the groove. The essentially vertical spacer 46 is formed at the other end of the lower arm 40. The top of this spacer establishes the minimum distance between the upper arm and the lower arm when they are compressed toward each other. The lower portion of this spacer facilitates the removal of the holder. By inserting a fingernail or tool between the spacer 46 and the surface to which the holder is attached and pushing the spacer upwardly (as shown in FIG. 2) so as to further compress the arms 38 and 40 together the holder may be easily removed. By this compression, the holder can be pulled out by grasping the spacer with the fingernails or by leveraging with a tool.

The unique attachment means described herein provides a very secure connection to the water bed frame. The pressure along the length of the holder is substantially even when compared to the prior art and thus a better, more even grip is created. And because of the design of the holder the material secured thereby cannot force the arms out of the groove. Of course, short length sections can be used to create a plurality of independent gripping or tension regions.

Figure 4:
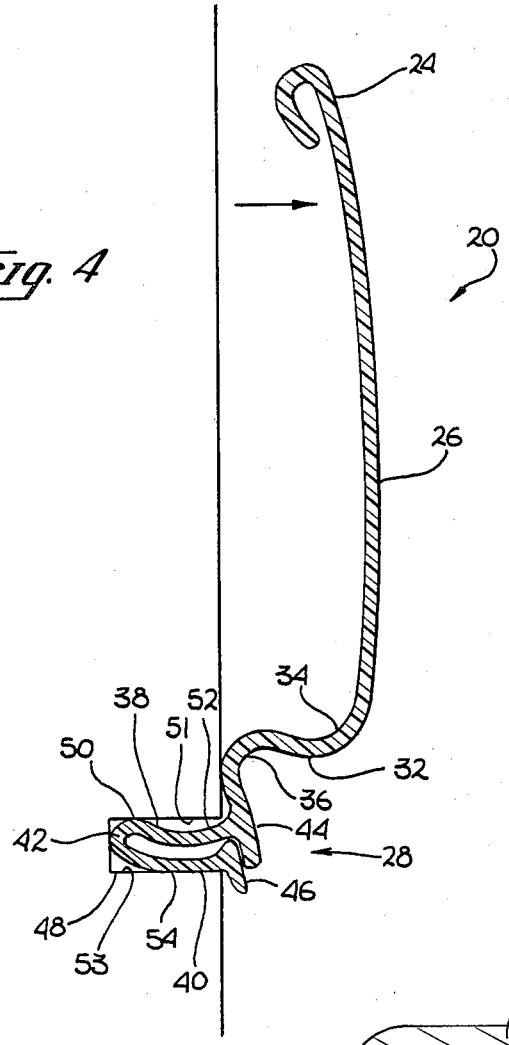
FIG. 4 is an elevational view of the holder attached to the frame and stressed.

Referring now to FIG. 4 the deformations undergone by the holder during tucking are illustrated. Initially, the base 42 of the holder will flex until the top of the spacer 46 rests against the upper arm 38. Any additional stress on the holder causes it to flex at the reverse S part of the leg portion. This configuration assists in insulating the leg portion from forces exerted upon the holder. As can be seen in FIG. 4, the reverse S includes the spine 32 and the curved fingers 34 and 36. The curved finger 36 flexes when the upper portion of the holder is pulled back to tuck the sheet material. The flexibility of the holler allows the upper portion to be pulled back at least one and a half inches facilitating the tucking of the material into the storage space 30.

After the base 42 flexes the location 52 is no longer in contact with the top 51 of the groove 48. However, locations 50 and 54 remain in contact with the upper and lower surfaces 51, 53 of the groove respectively. The same force that causes the base 42 to flex also tends to push locations 50 and 54 in closer and tighter contact with the groove thereby more securely attaching the holder.

An indication of the security of the attachment is that the arms will not loosen from the groove regardless of the force exerted against the upper portion of the holder. The holder will continue to flex until it fractures at the finger 36.

Figure 5:
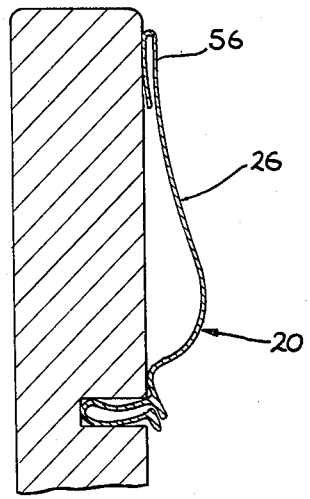
FIG. 5 is an elevational sectional view of a holder with a tapered top.
Figure 6:
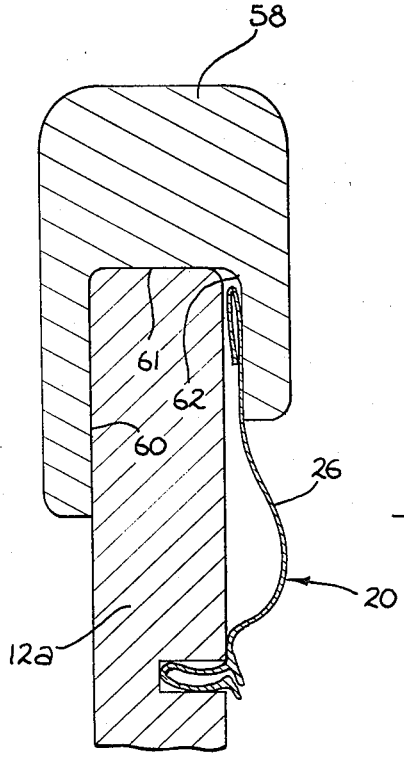
FIG. 6 is an elevational view of a holder with a padded cap rail mounted over the top of the holder and the frame.

Referring now to FIG. 5 there is illustrated a holder with a modified head portion 56. The head portion in this embodiment is radically tapered in order to present a minimum thickness. This tapered head is useful for several purposes. Among these is that the smaller surface area decreases the probability of accidental catching or pulling of the liner by the head portion. The tapered head portion can also be used in conjunction with a padded cap rail displayed in FIG. 6. A padded cap rail 58 covers the edge of the frame 12*a* providing a softer edge as well as a more aesthetically pleasing one. The cap contains inside vertical surfaces 60 and 62 and inside horizontal surface 64. These inside surfaces surround some of the bed frame as well as the head portion of the holder.

The distance between the inside vertical surface 60 and the inside vertical surface 62 is slightly greater than the width of the top of the bed frame. This enables the cap to slip over the head portion of the holder when positioned on the frame. When the cap is in position the inside horizontal surface 64 abuts the top surface of the frame. At the same time the inside vertical surfaces press the upper porton of the holder against the frame. This creates a stressed condition in the holder whose resiliency creates a spring-llike force directed outwardly away from the wall of the frame. Thus, the holder exerts a horizontal force against the cap rails. This spring-like force tightly secures the padded cap rail to the frame.

The thickness of the holder is especially important in the embodiment using the cap rail. It is desirable to maintain a tight and close fit between the cap and the frame. The thinner the holder, the closer the sides of the cap rail conform to the sides of the frame. The holder must not only be of the proper thickness to allow the cap to fit over it, but it must also be sufficiently flexible to squeeze when the cap rail is installed. In order to provide these qualities virgin polyvinylchloride has been found to be preferrable though up to 50% reground material or more can be mixed with virgin P.V.C. providing the material compound retains the necessary characteristics of resilience, fatique resistance and deterioration resistance. Several other synthetic materials may be suitable in addition to the P.V.C. These are A.B.S, polypropalene and various mixtures thereof.

It can be seen that the improved holder described herein can be easily and securely installed without necessitating the use of screws, bolts, or the like.

In operation, the U-shaped attachment means of the holder is pressed into the groove to secure the holder. This securing process is easily accomplished in a minimum amount of time. Next the assembly-person slips his fingers between the head portion of the holder and the surface. The fingers force back the head portion of the holder and allow the material to be tucked into the storage space. Once the fingers are removed the head portion snaps back against the surface securing the material in place.

By pulling back the head portion, the material can be withdrawn from the storage space. This insertion and removal of material can occur as often as desired. Thus, the holder can be used to instantly and removably secure a sheet material without harming the material.

The holder itself can also be easily removed without harming either itself or the surface to which it is attached. To remove the holder, the assembly-person merely pushes the spacer up, slips his fingernails or a tool between the spacer and the surface, and withdraws the holder.

What is claimed is:

1. A unitary resilient holder, to be attached to a surface that includes a groove, for restraining material in place against the surface comprising:

(a) a head portion for bearing against said surface, with said material being receivable between said head portion and said surface;

(b) a center portion connected to said head portion forming with said surface a space for storage of a portion of said material; and (c) a leg portion having a flattened generally U-shaped part, said leg portion being connected to said center portion and said U-shaped part being insertable into said groove and resiliently expandable against the groove from within it for detachably connecting said holder to said surface.

2. A unitary resilient holder, to be attached to a surface that includes a groove, for restraining material in place against the surface; said holder comprising:

(a) a head portion for bearing against said surface, with said material being receivable between said head portion and said surface;

(b) a center portion connected to said head portion and forming with said surface a space for storage of a portion of said material; and (c) a leg portion having a generally U-shaped part, said leg portion being connected to said center portion and said U-shaped part being insertable into said groove for detachably connecting said holder to said surface; said U-shaped part comprising:

a first arm adapted to extend into said groove and connected to said center portion, a second arm adapted to extend into said groove, and a base flexibly connecting said first arm with said second arm and adapted to be disposed transversely of such groove, the length of the base being less than half of the respective lengths of the first and second arms.

3. A holder as in claim 2 including grasping means for removing said holder from said surface.

4. A holder as in claim 3 wherein said grasping means comprises: a generally vertical spacer connected at the end of said second arm opposite said base to form a "T", said spacer for defining a minimum separation between said first arm and said second arm, and said spacer adapted to be easily grasped for withdrawing said U-shaped portion from said groove.

5. A holder as in claim 4 including a push bar connected at the end of said first arm opposite said base to form a "T" and to enable an assembly-person to press said U-shaped portion into said groove by pushing said bar.

6. A holder as in claim 1, for use in conjunction with a cap rail, wherein:

said head portion is tapered so as to be covered by said cap rail; and wherein said center portion is pressed toward said surface by said cap rail, the resiliency of said center portion creating a spring-like force directed against said cap rail to frictionally secure said cap rail in place.

7. In a unitary holding device for securing a variety of materials against a surface with a groove, said holder being a resilient element having a leg portion for positioning said device, a head portion biased to apply a force against said material and said surface for holding said material against said surface, and a center portion for containing some of said material, the improvement comprising:

said leg portion having a generally U-shaped part, said leg portion being connected to said center portion and said U-shaped part being insertable into said groove for detachably connecting said holder to said surface, said U-shaped part including:

an arcuate first arm, an arcuate second arm, and a base flexibly connecting said first arm with said second arm, said first arm biased to contact and press against a first surface of said groove in at least two locations, said second arm biased to contact and press against a second surface of said groove in at least one location, and said first and second arms tightly contacting the first and second surfaces of said groove for securely holding said unitary piece in position.

8. A unitary resilient holder, adapted for fastenerless attachment to a surface in which is formed a narrow groove having two opposed and very generally planar walls, for restraining material in place against such surface, said holder comprising:

(a) a head portion for bearing against said surface, with said material being receivable between said head portion and said surface;

(b) a center portion connected to said head portion and bowed to form with said surface a space for storage of a portion of said material; and (c) a leg portion having a generally U-shaped part, said leg portion being connected to said center portion and said U-shaped part being insertable into said groove for detachably connecting said holder to said surface, and the U-shaped part having two opposing arms that are:

biased mutually apart, for firm engagement with such very generally planar walls after insertion, and shaped to locate and firmly orient the leg portion with respect to such very generally planar walls after insertion.

9. The holder of claim 8 wherein the arms of the U-shaped portion are shaped to engage such walls in a three-point contact arrangement.

10. The holder of claim 8 wherein the U-shaped part also has a base that connects the two opposing arms and that is not biased into engagement with the groove.

11. A unitary resilient holder attached to a surface for restraining material in place against the surface, such material having an edge, the holder comprising:

(a) a head portion for bearing against such surface, such material being receivable between the head portion and such surface to effect such restraining;

(b) a leg portion having a generally U-shaped part, the U-shaped part being inserted into said groove and detachably connecting the holder to such surface, said V-shaped part being in direct contact with said groove; and (c) a center portion interconnecting said head and leg portions, and provided in the shape of a bow so as to form with said surface a space for storage of such material that is nearest such edge, so that such material that is nearest such edge does not pass between the leg portion and such surface.

12. The holder of claim 11:

wherein the said bow shape is sufficiently pronounced as to remove some of the center portion from contact with such surface, after insertion; and whereby such storage space is a free space.

* * * * *

UNITED STATES PATENT AND TRADEMARK OFFICE

CERTIFICATE OF CORRECTION

PATENT NO. : 4,395,797

DATED : August 2, 1983

INVENTOR(S) : Marvin I. May

It is certified that error appears in the above—identified patent and that said Letters Patent is hereby corrected as shown below:

At column 8, line 29, before "material having an edge" insert:

--surface having a groove and such-- .

At column 8, line 36, change "V-shaped" to read:

--U-shaped-- .

Signed and Sealed this

*Twenty-second* Day of *October 1985*

[SEAL]

*Attest:*

DONALD J. QUIGG

*Attesting Officer*

*Commissioner of Patents and Trademarks—Designate*